US006373009B1

(12) United States Patent
Prohaska et al.

(10) Patent No.: US 6,373,009 B1
(45) Date of Patent: Apr. 16, 2002

(54) FAIL SAFE SAFETY SWITCH

(75) Inventors: Richard D. Prohaska; Warren Clift Sipe, both of Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/503,795

(22) Filed: Feb. 14, 2000

(51) Int. Cl.[7] ..... H01H 23/00

(52) U.S. Cl. ..... 200/401; 200/468

(58) Field of Search ..... 200/468, 401, 200/430, 446, 329, 334, 335, 336, 337, 338, 50.01–50.2, 440, 442, DIG. 42

(56) References Cited

U.S. PATENT DOCUMENTS

| | | | | |
|---|---|---|---|---|
| 3,632,917 A | | 1/1972 | Norden | 200/42 T |
| 3,879,589 A | | 4/1975 | Rys | |
| 4,273,979 A | * | 6/1981 | Berndt et al. | 200/286 |
| 4,588,878 A | * | 5/1986 | Klein et al. | 200/153 G |
| 5,713,459 A | * | 2/1998 | Beck et al. | 200/401 |

* cited by examiner

*Primary Examiner*—P. Austin Bradley
*Assistant Examiner*—Nhung Nguyen
(74) *Attorney, Agent, or Firm*—Martin J. Moran

(57) ABSTRACT

A safety switch with a spring toggle linkage which causes the switch shaft to rapidly rotate for opening and closing the switch has a lost motion coupling between the switch handle and the switch shaft which engages at about the point of toggling to assure positive operation of the switch.

9 Claims, 5 Drawing Sheets

FAIL SAFE SAFETY SWITCH

BACKGROUND OF THE INVENTION

1. Field of the Invention

This invention relates to switches for electric power distribution systems. More particularly, it relates to a safety switch with an arrangement which assures positive operation of the spring toggle mechanism of such a switch.

2. Background Information

Safety switches are used in electric power distribution systems to isolate a load or a portion of the circuit. Typically, they include a switch mechanism housed in a sheet metal box. The switch mechanism has a number of switchblades mounted along a rotatable switch shaft. The shaft is rotated by a handle mounted at one side of the box and coupled to the shaft by a spring toggle mechanism which assures, by snap action, that the switch opens and closes rapidly. While such switches work very well under normal conditions, it is possible that the spring toggle linkage may not be able to effect the switching operation under some conditions, such as where the contacts become welded. This is a condition which can occur, for instance, in closing on a short circuit.

There is a need, therefore, for an improved safety switch of the type having a spring toggle linkage.

There is a particular need for such a safety switch with a capability of breaking any weld that might form between switch contacts.

More specifically, there is a need for such a safety switch which provides a direct mechanical coupling between the handle and the switch mechanism as the switch contacts open or close in addition to the coupling provided by the spring toggle linkage.

SUMMARY OF THE INVENTION

These needs and others are satisfied by the invention which is directed to a safety switch which is provided with a lost motion coupling between the handle and the switch shaft of the switch mechanism in addition to the spring toggle linkage. This lost motion coupling provides a direct mechanical connection between the handle and the switch shaft which is effected as the spring toggle linkage approaches the over center position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
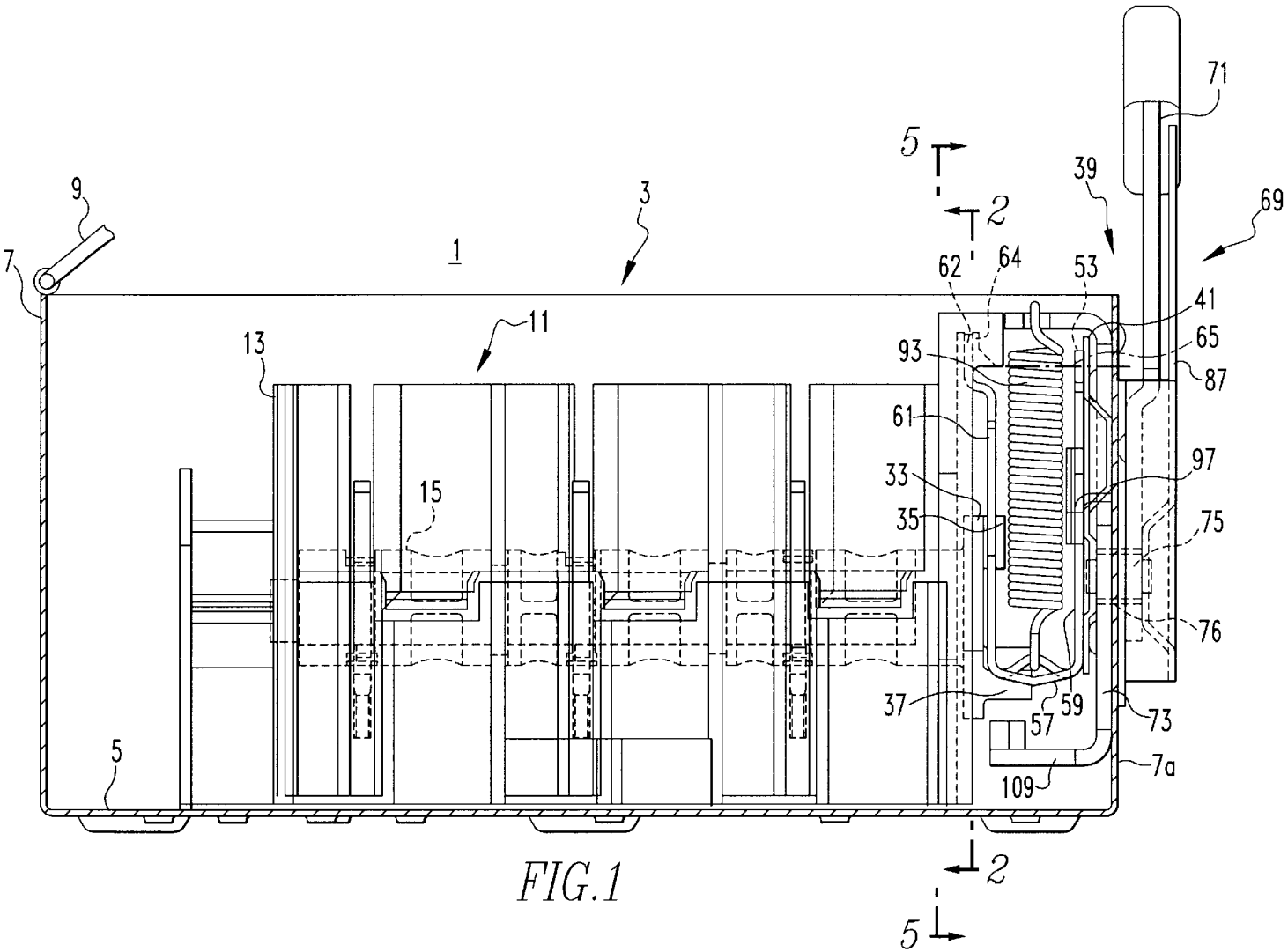
FIG. 1 is an elevation view of a safety switch in accordance with the invention with a side wall removed.
Figure 2:
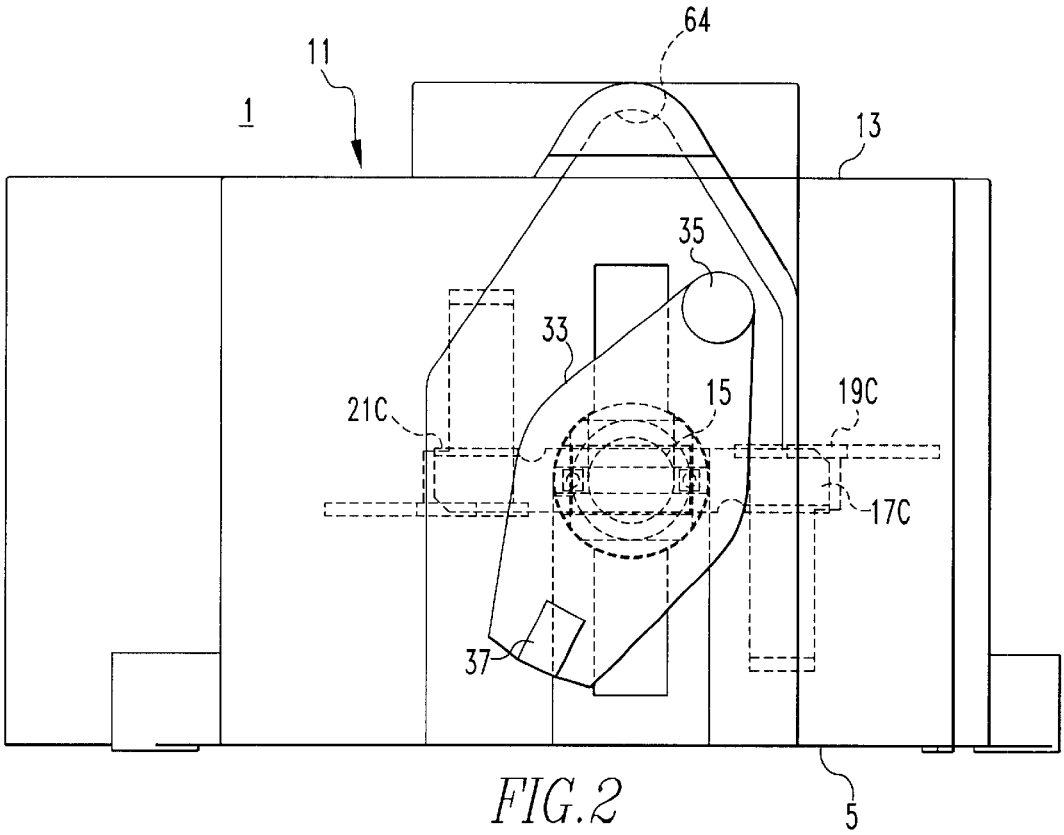
FIG. 2 is a vertical section taken along the line 2—2 of FIG. 1.
Figure 3:
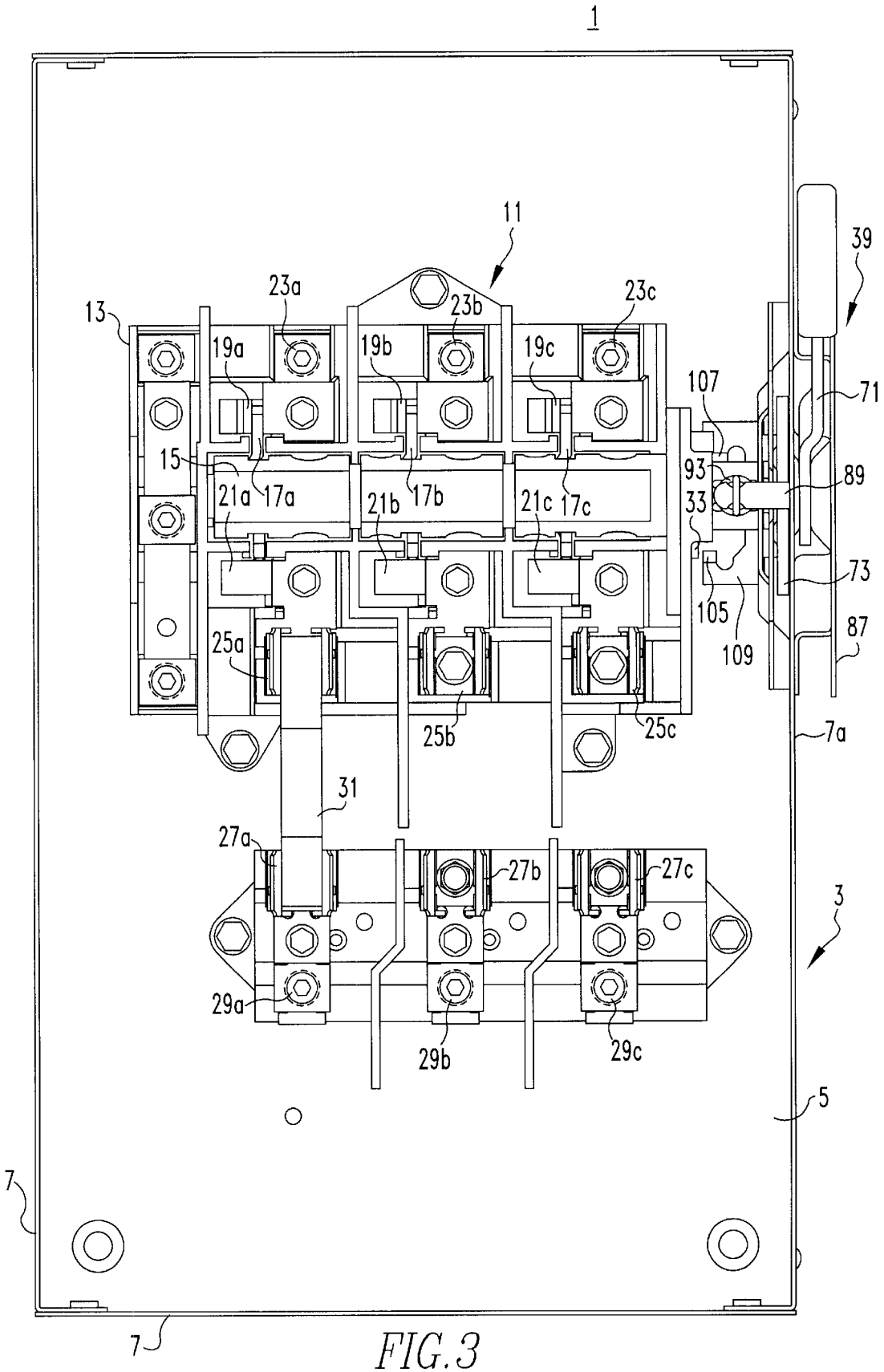
FIG. 3 is a plan view of the safety switch shown in the on position.

Referring to FIGS. 1–3, the safety switch 1 includes a housing 3 in the form of a sheet metal switch box having a rear wall 5, side walls 7 and a hinged cover 9 (shown in part in FIG. 1). Housed within the box and mounted to the rear wall is a conventional switch mechanism 11. Such switch mechanisms are known and include an insulative molded housing 13 in which an electrically insulative switch blade shaft 15 is rotatably mounted. This switch blade shaft 15 carries a switch blade 17*a*–17*c* for each pole of the switch. The switch shown is a 3 pole switch and therefore has 3 switchblades. Each switchblade has two ends, one of which in the on or closed state shown in FIGS. 1–3 engages an associated line contact jaw 19*a*–19*c* and a second end that engages an associated load contact jaw 21*a*–21*c*. As is well known, the contact jaws are U-shaped members into which the associated switchblade ends slide during rotation of the switchblade shaft 15. Line terminals 23*a*–23*c* provide connections for of line conductors (not shown) to the line contact jaws 19*a*–19*c*. On the load side, the load contact jaws 21*a*–21*c* are electrically connected to a first set of fuse clips 25*a*–25*c*. A second set of fuse clips 27*a*–27*c* are electrically connected to load terminals 29*a*–29*c*. Fuses 31 (only one shown) are placed in corresponding clips in the first and second sets of fuse clips 25 and 27 to provide protection for overcurrents.

The switchblade shaft 15 is rotated by a crank 33 on one end. As shown in FIG. 2, a first coupler 35 is integrally molded on the crank 33 eccentric to the axis of the switchblade shaft 15. A second coupler 37 is integrally molded with the crank diametrically opposite the first coupler 35. The switch mechanism is shown in FIG. 2 in the on or closed state. Rotation of the crank 33 counterclockwise as viewed in FIG. 2 moves the switchblades to the off or open state.

Figure 4:
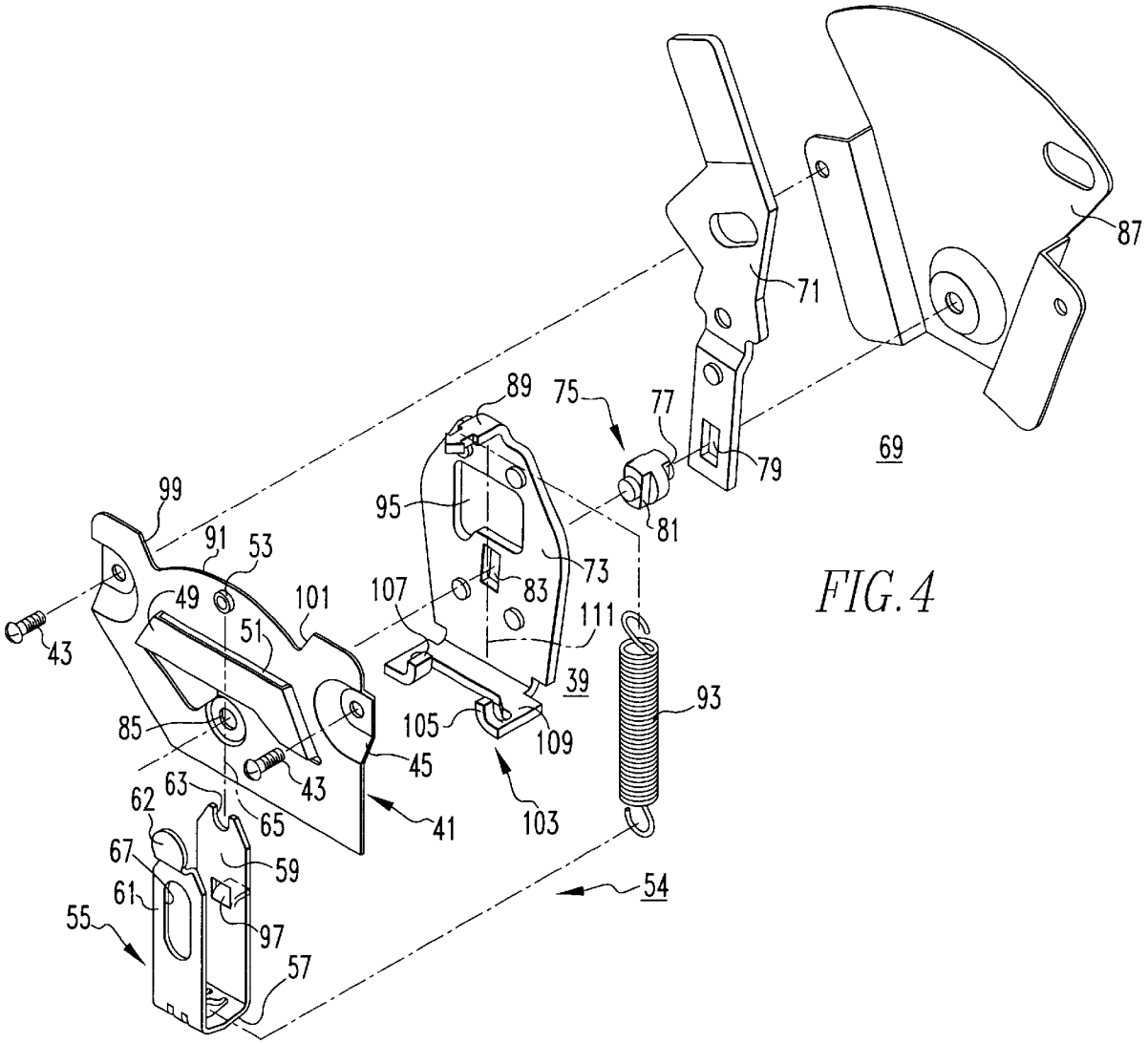
FIG. 4 is an exploded isometric view of an operating assembly which forms part of the safety switch.

The crank 33, and therefore the switch mechanism 11, are operated between the open and closed states by an operating assembly 39 which can best be understood by reference to FIG. 4. This operating assembly 39 includes a bracket 41 which is secured to a side wall 7*a* of the housing 3 facing the crank 33 of the switch mechanism. The bracket 41 is secured to the side wall 7*a* by fasteners 43 which are seated in offset sections 45 in the brackets so that the main body 47 of the bracket is spaced from the side wall 7*a*. A strip 49 of the main body 47 of the bracket 41 is punched out to form an elongated horizontally extending slot 51. A punched aperture 53 forms a neck which serves as a first pivot axis.

Figure 6:
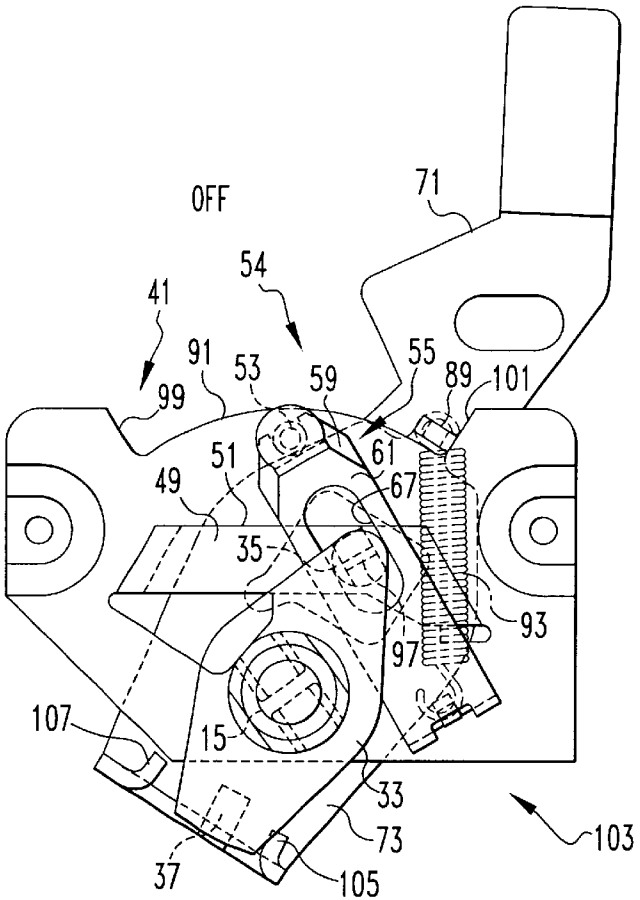
FIG. 6 is a view similar to that of FIG. 5 but showing the operating mechanism in the off or open state.
Figure 5:
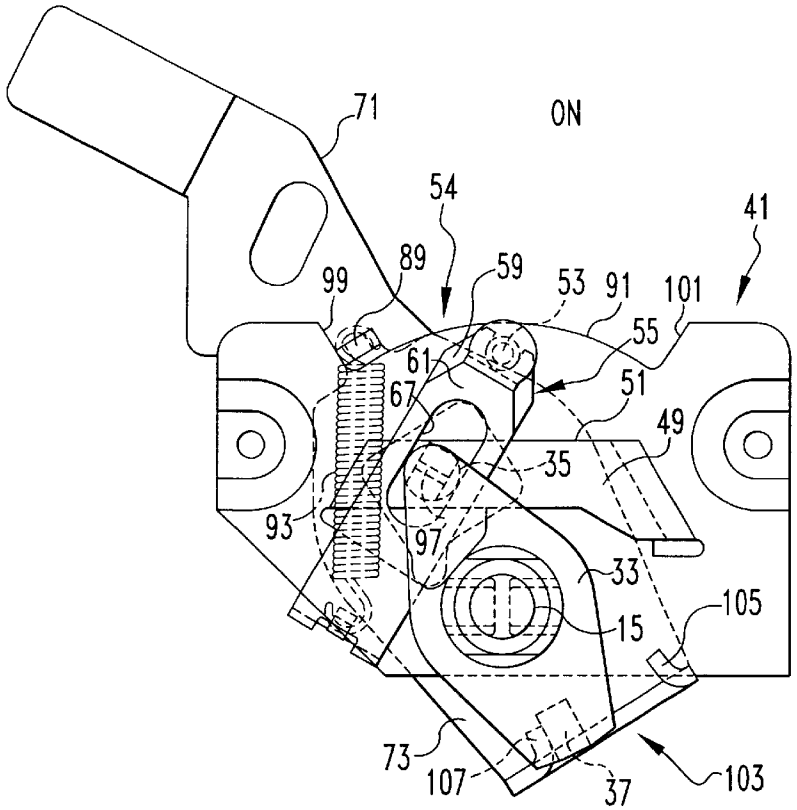
FIG. 5 is a vertical section taken along the line 5–5 of FIG. 1 showing the operating mechanism in the on or switch closed state.

The operating assembly 39, which is shown exploded in FIG. 4 for clarity, incorporates a spring toggle linkage 54 which includes a U-shaped operating member 55 having a bight 57 and first and second legs 59 and 61. The first leg 59 is beveled at its free end and has a slot 63 which pivotally seats on the first pivot 53 on the bracket 41. This first leg 59 extends through the elongated slot 51 in the bracket 41 as can be seen in FIGS. 5 and 6. Pivotal movement of the operating member 55 about the pivot 53 is limited at each end by the ends of the slot 51.

The free end 62 of the second leg 61 of the operating member 55 is circular and seats in a pocket 64 (see FIG. 2) molded into the housing 13 of the switch mechanism. This pocket 64 and the first pivot 53 on the bracket form a pivot axis 65 (see FIG. 1) about which the operating member 55 pivots. The second leg 61 of the operating member 55 has a longitudinal slot 67 which engages the first coupler 35 on the crank 33.

The operating assembly 39 further includes a handle unit 69. This handle unit 69 includes an elongated handle 71 and a drive link 73. The handle 71 and the drive link 73 are secured together for rotation as a unit with the handle on the outside of the wall 7*a* and the drive link inside the wall between the wall and the bracket 41 by a handle pivot pin 75 which has a first pair of flats 77 which engage a rectangular aperture 79 in the handle 71 and a second pair of flats 81 which engage a rectangular aperture 83 in the drive link. One end of the handle pivot pin 75 is seated in an aperture 85 in a recess in the bracket 41. The other end of the handle pivot pin 75 is seated in a guard 87 mounted over the handle 71 outside the wall 7*a* The cylindrical center section of the handle pivot pin 75 rotates in an aperture 76 in the side wall 7*a* (see FIG. 1). The cylindrical center section of the handle pivot pin 75 rotates in an aperture 76 in the side wall 7*a* (See FIG. 1). With this arrangement, the handle 71 and drive link 73 move as a unit.

The drive link 73 has a first projection in the form of tang 89 which projects over and follows along an arcuate section 91 on the bracket 41. A helical tension spring 93, which forms part of the spring toggle linkage 54, is connected at one end to the bight 57 of the operating member 55 and at the other end to the tang 89. The drive link 73 also has a cam opening 95 which is engaged by a tab 97 punched out of the first leg 59 of the operating member.

As shown in FIG. 5, with the handle 71 rotated counterclockwise to a first or on position, the tang 89 on the drive link 73 is at the counterclockwise end of the arcuate surface 91 on the bracket 41 and is held against a stop formed by the on stop surface 99 on the bracket 41 by the tension spring 93 which also holds the operating member 55 with the first leg 59 against the stop formed by the left end of the slot 51 in the bracket. As the first coupler 35 on the crank 33 is engaged by the slot 67 of the second leg 61 of the operating member, the switchblade shaft 15 is held in the on state.

As the handle 71 is rotated clockwise as viewed in FIGS. 5 and 6 from the on position toward the off position, the tang 89 moves clockwise above the arcuate surface 91, thereby stretching the tension spring 93 since the operating member 55 is prevented from rotating clockwise by the left end of the slot 51. As the tang 89 passes the pivot 53 about which the operating member 55 rotates, the spring toggle linkage 54 goes over center. As the line of force of the stretched tension spring 93 is now to the right of the pivot 53 the operating member is rapidly rotated counterclockwise until the first leg 59 reaches the right hand end of the slot 51. Simultaneously, the handle unit 69 is rapidly rotated clockwise until the tang 89 reaches the off stop surface 101 at the clockwise end of the arcuate surface 91. Again, as the first coupler 35 on the crank 33 is engaged by the slot 67 in the second leg 61 of the operating member 55, the crank and therefore the switchblade shaft 15 are rapidly rotated to the open position. This rapid opening of the switchblade helps to assure interruption of the current through the switch. In order to assure that the snap action occurs consistently at the same point in the movement of the handle, the tab 97 on the first leg 59 of the operating member 55, engages the drive link 73 through the cam opening 95 as the line of force of the spring 93 passes the pivot 53.

When the handle 71 is moved from the off position in FIG. 6 toward the on position in FIG. 5, the operating member 55 remains in the position shown in FIG. 6 until the tang 89 in moving counterclockwise passes the pivot 53. With the line of force of the spring 93 now to the left of the pivot, the operating member 55 is snapped in a clockwise direction to the position shown in FIG. 5 thereby rapidly rotating the switchblade shaft 15 and closing the switch. Again, the tab 97 contacts the drive link to assure that the snap action occurs consistently at the same position in the movement of the handle 71.

The safety switch as described to this point is known. There can be situations, such as closing the switch on a short circuit in which the switchblade contacts can become welded in the closed position. Under these circumstances, even though the handle is moved, the switchblade shaft 15 can be frozen and the spring and the tab 97 are not capable of generating sufficient force to break the weld. In accordance with the invention, the drive link 73 is provided with a lost motion coupling 103 which allows the spring toggle linkage 54 to operate normally, but allows additional force to be applied to break a weld if necessary. This lost motion coupling 103 includes a pair of spaced apart engagement members formed by second and third tangs 105 and 107 formed on the opposite end of the drive link 73 from the tang 89. Preferably, these tangs 105 and 107 are formed in confronting relation on a flange 109 on the drive link 73. After initial movement of the handle from the on position (FIG. 5) or off position (FIG. 6) the tang 105 or 107, respectively, engages the second coupler 37 on the crank 33 to break any weld of the switchblade contacts and assure that the spring toggle linkage 54 toggles. In the preferred arrangement, the tangs 105 and 107 are spaced such that they engage the second coupler 37 about at the point where the spring toggle linkage 54 toggles. Thus, the tangs 105 and 107 are spaced on either side of a diameter 111 which passes through the first tang 89.

In the preferred embodiment of the invention illustrated, the handle unit 69 includes a handle 71 and a drive link 73 which rotate together with the drive link 73 inside the housing 3 and the handle 71 outside the housing. This eliminates the need to have a slot in the cover for movement of the handle 71, and therefore, enhances the weatherproofing of the safety switch. In installations where this is not critical, the handle can be mounted inside the box and extend through the cover. In this arrangement, the tangs 89, 105 and 107 can be integrally formed on the elongated handle which can also have a cam opening similar to the cam opening 93 for the tab 97 on the first leg 59 of the operating member 55.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A safety switch comprising:

a switch box having a rear wall, side walls, and a cover;

a switch mechanism mounted in said switch box and including a switch shaft having a crank on one end of said switch shaft for rotating said switch shaft to alternately operate said switch mechanism between an open state and a closed state; and an operating assembly comprising:

a handle unit pivotally mounted adjacent one side wall of said switch box;

a spring toggle linkage coupling said handle unit to said crank for rotation of said crank and with it said switch shaft; and a lost motion coupling also coupling said handle unit to said crank for rotating said crank and said switch shaft.

2. The safety switch of claim 1 wherein said lost motion coupling comprises a pair of spaced apart engagement members engaging said crank only after initial movement of said handle unit.

3. The safety switch of claim 1 wherein said spring toggle linkage comprises:

a bracket mounted between said one side wall and said switch mechanism, said bracket having a first pivot support, and said switch mechanism having an opposed second pivot support, said first and second pivot supports forming a pivot axis;

a U-shaped operating member having a bight and first and second legs extending from said bight, said first leg being pivotally supported on said first pivot support and said second leg being pivotally supported on said second pivot support, said second leg being coupled to said crank; and a tension spring connected at one end to said bight of said operating member and at a second end to said handle unit, said tension spring toggling said operating member and handle unit between a first position in which the switch mechanism is in said closed state and a second position in which said switch mechanism is in said open state, said tension spring snapping said operating member and handle unit alternately between said first and second positions as a line of action of said tension spring crosses said pivot axis, said lost motion coupling engaging said crank about as said line of action of said tension spring approaches said pivot axis.

4. The safety switch of claim 3 wherein said crank has a first coupler offset from said switch shaft which couples said crank to said second leg of said operating member, and wherein said lost motion coupling comprises a second coupler on said crank about diametrically opposite said first coupler and a pair of engagement members spaced apart on said handle unit and engaging said second coupler after lost motion during initial movement of said handle unit.

5. The safety switch of claim 4 wherein said crank comprises a lever having said first coupler adjacent a first end and said second coupler adjacent a second end, said lever being mounted on said switch shaft intermediate said first and second ends.

6. The safety switch of claim 4 wherein said handle unit includes an elongated handle outside said one side wall, a drive link inside said one side wall, and a handle pivot journaled in an aperture in said one side wall and securing said elongated handle and drive link for pivotal movement together, said drive link having a first tang to which said second end of said tension spring is connected, said drive link having second and third spaced apart tangs forming said spaced apart engagement members of said lost motion coupling.

7. The safety switch of claim of 6 wherein said crank comprises a lever having said first coupler adjacent a first end and said second coupler adjacent a second end, said lever being mounted on said switch shaft intermediate said first and second ends.

8. The safety switch of claim 7 wherein said second and third tangs on said drive link straddle a diameter extending through said first tang.

9. The safety switch of claim 6 wherein said second and third tangs on said drive link straddle a diameter extending through said first tang.

* * * * *